US010186338B2

(12) United States Patent
Paris et al.

(10) Patent No.: US 10,186,338 B2
(45) Date of Patent: Jan. 22, 2019

(54) RADIOISOTOPE GENERATOR

(71) Applicant: INSTITUT NATIONAL DES RADIOÉLÉMENTS, Fleurus (BE)

(72) Inventors: Jérôme Paris, Heron (BE); Thierry Dierickx, La Louvière (BE); Philippe Vanwolleghem, Ottignies-LLN (BE); Valery Host, Ohey (BE); Steve Dierick, Hoeilaart (BE)

(73) Assignee: INSTITUT NATIONAL DES RADIOELEMENTS, Fleurus (BE)

( * ) Notice: Subject to any disclaimer, the term of this patent is extended or adjusted under 35 U.S.C. 154(b) by 0 days.

(21) Appl. No.: 15/516,982

(22) PCT Filed: Oct. 6, 2015

(86) PCT No.: PCT/EP2015/072971

§ 371 (c)(1),
(2) Date: Apr. 5, 2017

(87) PCT Pub. No.: WO2016/055429

PCT Pub. Date: Apr. 14, 2016

(65) Prior Publication Data

US 2017/0294246 A1 Oct. 12, 2017

(30) Foreign Application Priority Data

Oct. 7, 2014 (BE) ..... 2014/00745

(51) Int. Cl.
*G21G 4/08* (2006.01)
*G21G 1/00* (2006.01)

(52) U.S. Cl.
CPC ..... *G21G 4/08* (2013.01); *G21G 1/0005* (2013.01)

(58) Field of Classification Search
CPC ..... G21G 1/0005; G21G 1/001; G21G 4/08; A61K 51/1282; A61M 2205/051; A61M 5/007; A61M 5/1407; A61M 5/1452; A61M 5/16827; A61M 5/172
USPC ..... 210/682; 423/11; 600/431
See application file for complete search history.

(56) References Cited

U.S. PATENT DOCUMENTS 4,585,941 A * 4/1986 Bergner ..... A61M 5/1407 250/363.02
2003/0127395 A1* 7/2003 Bond ..... B01J 39/04 210/682
2017/0294246 A1* 10/2017 Paris ..... G21G 4/08

FOREIGN PATENT DOCUMENTS

WO 2014063198 A1 5/2014

* cited by examiner

*Primary Examiner* — David A Vanore
(74) *Attorney, Agent, or Firm* — Browdy and Neimark, P.L.L.C.

(57) ABSTRACT

The invention relates to a radioisotope generator (1) comprising an eluent reservoir (2) and a chromatographic column (3) connected to one another by a first eluent duct (4), characterized in that it comprises a second duct (7) and a valve (8) connected said second duct (7) to the first eluent duct and the first eluent duct, said valve (8) having a first position where the second duct (7) communicates with the first eluent duct (4) and a second position where the second duct (7) communicates with the first eluent duct (4), said second duct (7) having a bypass segment (9) for a predetermined eluent volume.

17 Claims, 3 Drawing Sheets

RADIOISOTOPE GENERATOR

Figure 1:
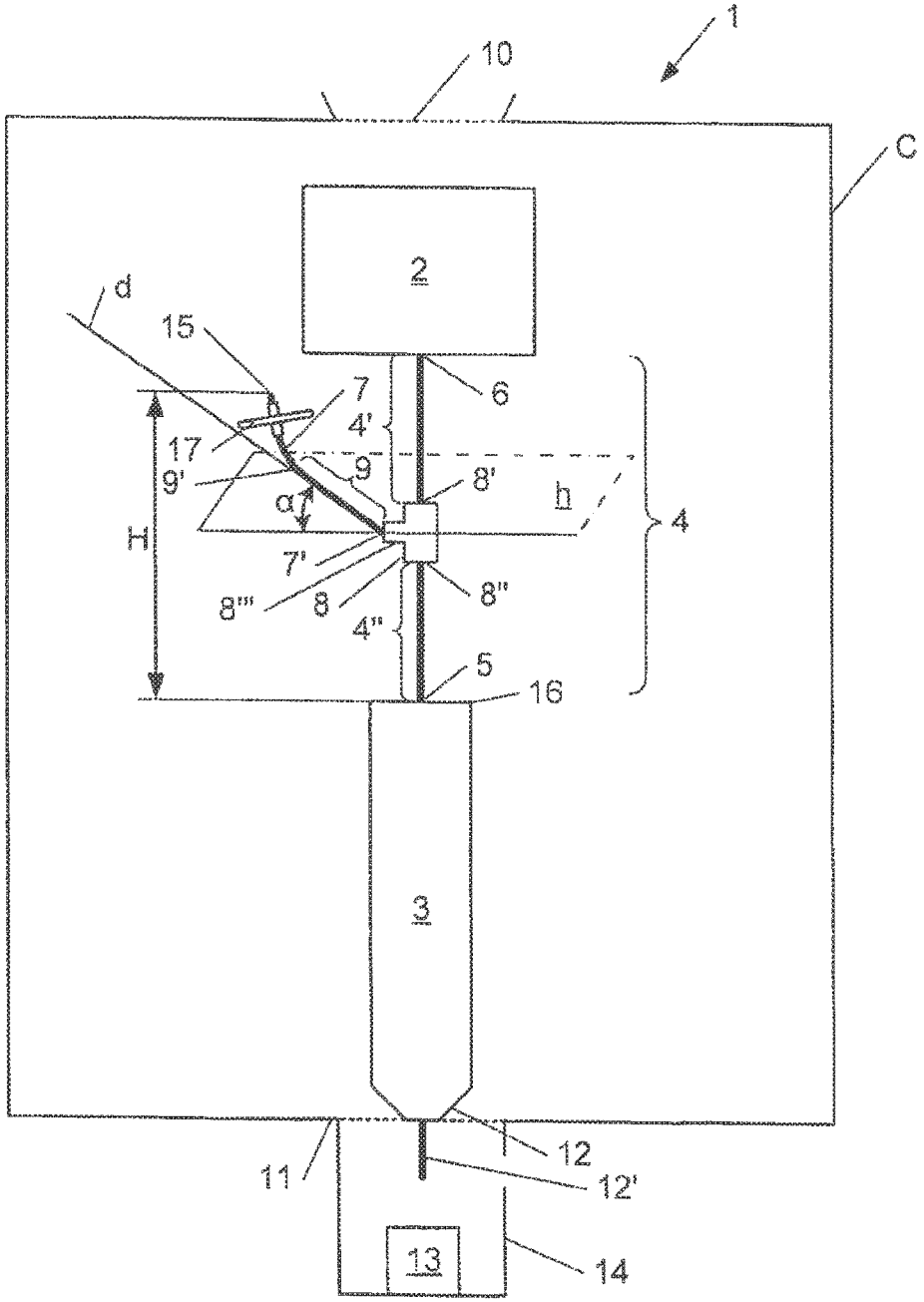

The present invention relates to a radioisotope generator for medical applications, preferably positioned in a shielded box, said box preferably being made at least partially from a dense material, for example tungsten or lead, comprising an eluent reservoir and a chromatographic column connected to one another by a first eluent transmission duct, said chromatographic column having a stationary phase loaded with a parent radioisotope disintegrating spontaneously into a daughter radioisotope.

This radioisotope generator is used, inter alia, in the field of nuclear medicine to produce a radioisotope eluate (daughter radioisotope) from a source (i.e., a chromatographic column having a stationary phase loaded with parent radioisotopes that disintegrate spontaneously into daughter radioisotopes that are designed to be eluted by an eluent). These daughter radioisotopes in the eluate are designed to be used as such or to bond to a molecule, for example a biocompatible molecule (protein, antibody, etc.) so as to form a radio-marked molecule, resulting from the combination of the daughter radioisotope with the molecule, which is generally next administered to a patient by injection, typically in the form of a solution or a liquid suspension, when the molecule is biocompatible. The administration of the radioisotope or the radio-marked molecule makes it possible in that case to diagnose or treat certain cancers, depending on the choice of the radioisotope and/or biocompatible molecule.

In the particular context of the preparation of a solution or a suspension comprising a radioisotope or a radio-marked biocompatible molecule designed to be administered to a patient, many constraints arise.

Indeed, it is first necessary to make sure that the production and withdrawal of the eluate comprising the daughter radioisotopes, as well as the marking reaction of the biocompatible molecule by the daughter radioisotope to form the radio-marked molecule, is done under sterile conditions.

Next, in order for the marking reaction to be as effective as possible, it is important to have an eluate that has a high degree of purity in daughter radioisotopes, i.e., an eluate highly concentrated in daughter radioisotopes and in which the presence of contaminants that may cause interference in or inhibit the marking reaction is low enough not compromise that marking reaction.

Unfortunately, the phenomenon of passage of the parent radioisotopes through the stationary phase of the column, or breakthrough, is often inherent to the working of the generator described below and is problematic.

In fact, this phenomenon corresponds to unwanted driving by the eluent of parent radioisotopes that detach from (or do not attach to) the stationary phase and find themselves in the eluate at the outlet of the chromatographic column.

This results in an eluate that comprises a mixture of parent and daughter radioisotopes, and which, after the marking reaction, is administered to the patient and may be toxic if the parent radioisotope activity in the solution or suspension comprising the radio-marked biocompatible molecule is too high.

Within the meaning of the present invention, the term "parent radioisotope(s)" refers to the radioisotope initially loaded on the stationary phase as well as the intermediate-generation radioisotopes that will supply the daughter radioisotope. Indeed, in some cases, the decomposition of the parent radioisotope produces a compound with a very short half-life that in turn decomposes into a daughter radioisotope of interest. These radioisotopes of a higher generation than the daughter radioisotopes of interest are called "parent radioisotopes".

Within the meaning of the present invention, "daughter radioisotope(s)" refers to the radioisotope(s) resulting from the decomposition that will be the eluted radioactive molecule of interest for uses in nuclear medicine, biomedical research and diagnostics.

One solution to reduce this "breakthrough" is to produce an elution of the stationary phase of the column with a significant volume of eluent to next re-concentrate the eluate resulting from such a solution using a re-concentrator in order to increase the concentration thereof in daughter radioisotopes and decrease the activity thereof in parent radioisotopes to a threshold value that cannot be exceeded and for which toxic effects of that radioisotope cannot manifest in the individual receiving the solution or the suspension comprising the radio-marked biocompatible molecule from the re-concentrated eluate.

In this method, which takes place before the marking reaction with a biocompatible molecule, the re-concentrator is placed downstream from the generator and connected to the generator at the outlet of the chromatographic column. During the re-concentration, the daughter radioisotopes, circulated by a vector solution (typically a physiological saline solution), are retained by a stationary phase that has a specific affinity with these radioisotopes, such that only the latter are retained by this stationary phase. The stationary phase is further deliberately chosen so that a small volume of solution suffices, for example using physiological serum (approximately 1.5 ml to 5.0 ml) and thus makes it possible to have a re-concentrated eluate with a limited volume but in which the activity in daughter radioisotopes is high enough and the activity in parent radioisotopes is low enough to be compatible with the aforementioned medical applications.

However, this re-concentration step is costly, since it requires establishing an additional re-concentration system, and long enough to observe a significant loss in the performance of the daughter radioisotope activity in the re-concentrated eluate thus obtained, which constitutes a loss of profitability of the generator, and an additional risk of contamination.

Another solution lies in producing, from the generator, a fractionated solution well known by those skilled in the art, which consists of collecting eluate by predetermined volume fractions and retaining and joining the fractions in which, on the one hand, the parent radioisotope activity is deemed low enough, and on the other hand, the daughter radioisotope activity is high enough for medical applications.

Unfortunately, like the re-concentration step, the fractionated solution has the drawback of being a long enough method, since it is necessary, between each fraction, to interrupt the flow of eluate to identify the parent radioisotope activity. This is reflected in a significant loss of performance of the daughter radioisotope activity performance in the eluate thus obtained, which constitutes a loss of profitability of the generator, and again a risk of contamination. The fractionated solution, to be effective, then requires the use of a maintenance system that makes it possible to determine the correct fractionating and allows the real-time measurement of the parent and daughter radioisotope activities in each fraction, which constitutes an alternative at least as complex as the re-concentration step.

Next, the establishment of a fractionated elution of the stationary phase is also problematic when it involves producing an eluate loaded with daughter radioisotopes under sterile conditions. In that case, it is in fact necessary to ensure that each container, designed each to receive an eluate fraction, is sterile, and that the step for pooling the fractions comprising the daughter radioisotopes is done under sterile conditions, which constitutes a non-negligible logistical, and de facto costly, constraint.

There is therefore a need to have a generator that makes it possible to reduce this breakthrough phenomenon and to obtain, directly after elution, a sterile eluate in which the parent radioisotope activity is low enough and the daughter radioisotope activity is high enough, such that this eluate is directly usable and implemented in the form of a solution of radio-marked molecules.

Document US 2011/0280770 proposes to meet this need by providing a generator comprising an elution line connecting the chromatographic column to the first eluent reservoir (upstream) and to the eluate outlet (downstream). This elution line comprises a first pinch valve arranged to regulate the flow of eluent from the reservoir toward the column, and a second pinch valve placed on a bypass of the elution line. This duration procures a loading line for parent radioisotope ($^{62}Zn$) concentrated in a liquid phase. In this context, the second pinch valve therefore makes it possible to selectively regulate the arrival of $^{62}Zn$ radioisotope in the column. A third pinch valve is present on the elution line, at the eluate outlet, downstream from the chromatographic column. This third line is intended to make it possible to regulate the flow at the outlet of the column toward a second eluate reservoir.

However, the generator according to document US 2011/0280770 still has a complex design, since operation requires the continuous monitoring, during the elution of the stationary phase of the column, using controls, on the one hand, of at least two flow rates: the $^{62}Zn$ loading flow rate from the bypass line toward the column and the eluent outlet flow rate from the eluent reservoir toward the column, and on the other hand, volumes of solution loaded with parent radioisotopes and eluent.

Other devices are also known from documents US 2003/0127395 and U.S. Pat. No. 4,585,941 and describe systems depending on a pumping system to perform. the elution process.

The aim of the present invention is to provide a radioisotope generator whose design is simplified and which therefore allows easier use, under sterile conditions, than the generator described in document US 2011/0280770 while eliminating the problem of breakthrough.

According to the present invention, this aim is achieved by having a generator as described above, characterized in that it comprises a second duct and a valve housed between an upstream part of the first eluent duct and a downstream part of the first eluent duct, and connecting said second duct to said upstream part of the first eluent duct and to the downstream part of the first eluent duct, said valve having a first position in which the second duct is in fluid communication with said upstream part of the first eluent duct and a second position in which the second duct is in fluid communication with said downstream part of the first eluent duct, said second duct having a bypass segment for a predetermined volume of eluent, said segment being defined directly between said valve and a segment end, said predetermined eluent volume being a sufficient volume to obtain, when said sufficient volume crosses through the chromatographic column, under the action of a driving force of the eluent, an eluate comprising a parent radioisotope activity comprised in a value range from 0.0% to 30.0% relative to a daughter radioisotope activity of said eluate.

The presence of the second duct in fluid communication, via the valve, with the first duct connecting the eluent reservoir to the chromatographic column, makes it possible to have a generator that is completely sterile once the reservoir, the first and second ducts and the valve are sterilized beforehand before being interconnected to one another to form a closed elution line and connected to the chromatographic column of the generator. Alternatively, the various aforementioned elements are interconnected and the resulting elution line is next sterilized as a whole.

Furthermore, the generator according to the invention only requires monitoring one valve to generate an eluate that is directly usable for medical applications, the withdrawn volume being predetermined by the predetermined length and diameter of the bypass segment.

Indeed, when the user wishes to perform an elution, he first positions the valve in its first position, which is a position in which the second duct is in fluid communication with said upstream part of the first eluent duct so as to charge the bypass segment with eluent through a predetermined and sufficient eluent volume.

Next, when the bypass segment is filled with eluent, the user positions the valve in its second position, in which the second duct is in fluid communication with said downstream part of the first eluent duct, and the eluent is discharged from the bypass segment toward the chromatographic column.

Once the elution is complete, the activity of the daughter radioisotope, which does not cease to be generated in the column from the parent radioisotope loaded on the column, increases to reach an activity threshold value that cannot be exceeded and that is governed by an equilibrium between the parent radioisotope and the daughter radioisotope. A cycle is thus formed, and it is the frequency between the successive elutions that determines the respective parent and daughter radioisotope activities in the eluate obtained for each of these successive elutions.

The predetermined volume here corresponds to the sufficient and optimal volume to elute, in very large majority, the daughter radioisotope resulting from the disintegration and a minimal fraction of parent radioisotope, thus reducing the breakthrough phenomenon.

Indeed, the predetermined volume makes it possible to obtain, after elution of the column, an eluate in which the measured daughter radioisotope activity is comprised in a value range from 60.0% to 100.0%, preferably from 70.0% to 100.0%, more particularly greater than 80.0% relative to the daughter radioisotope activity present on the column at the time of the elution, whereas the parent radioisotope activity in the eluate is comprised in value range from 0.0% to 30.0% relative to the daughter radioisotope activity of said eluate.

The generator according to the present invention therefore makes it possible, for each elution with a sufficient predetermined eluent volume, to obtain an elution profile of the daughter radioisotope that is quite surprising. Indeed, as explained above, in the existing wet generator systems, i.e., for which the elution is done continuously, the elution profile of the daughter radioisotope traditionally has a first fraction comprising a majority of the parent radioisotope preceding a second fraction comprising a majority of the daughter radioisotope.

On the contrary, in the context of the present invention, it has surprisingly been observed that the activity of the parent radioisotope [in] the eluate is reduced enough for this eluate to be directly usable in the aforementioned medical applications.

Thus, with the generator according to the present invention, for an elution with the predetermined sufficient volume of eluent, it is also easy, and under sterile conditions, not only to monitor the parent radioisotope activity in the eluate, but also to have a sufficient daughter radioisotope activity, so as to obtain an eluate that is directly usable in medical applications.

Indeed, the eluate obtained by the passage of the predetermined volume of eluent in the chromatographic column of the generator according to the invention has an elution peak of the daughter radioisotope that is narrow and substantially lacks parent radioisotopes by optimization of the synchronization between the elution and the complete generation of daughter radioisotopes on the stationary phase depending on the secular disintegration cycle of the parent radioisotopes.

During the lifetime of the generator, the daughter isotope solutions of interest are recovered through a series of loading and unloading operations of the segment, alternating, until the eluent contained in the reservoir is exhausted: it therefore involves a discontinuous elution that consists of a series of elutions with a sufficient volume of eluent.

In this context, each elution is associated with a withdrawal of a volume of eluate intended for an appropriate medical use.

Between each elution, the user will be sure to dry the column, for example by pumping sterilized ambient air from the segment end or from a free end of the second duct toward the eluate outlet.

The drying makes it possible to discharge a residual volume of excess eluent present in the column, and thus to minimize the risk of seeing the parent radioisotope migrate toward the eluate outlet of the column between two successive elutions.

The choice of the sufficient predetermined volume is determined by the elution profile of the radioisotopes, and therefore: (i) by the physicochemical properties of the chromatographic column and the eluent; (ii) as well as by the pair of parent and daughter radioisotopes used.

The generator according to the invention therefore constitutes a similar design and usage alternative to the solutions proposed in the state of the art, and in particular to the solution provided by conventional dry generators, for which it is systematically necessary to load the column manually by injecting a predetermined volume of eluent, this type of generator by definition not comprising an eluent reservoir.

Indeed, the difficulty inherent to the use of this type of generator [lies] in the fact that it is necessary to ensure a sterile connection for each eluent injection in the column in order to avoid contamination risks.

Preferably, said reservoir is situated above said chromatographic column, said segment end, which can be a free end of the second duct, being positioned at a sufficient height, measured from an apical end of the chromatographic column, such that the gravitational force has a sufficient intensity to allow a flow of the eluent through the withdrawal segment.

Advantageously, at least one bypass segment part connected to said valve is inclined relative to a horizontal plane by an angle $\alpha$ having a predetermined value such that its sine value is greater than 0 and less than or equal to 1, and its cosine value is between −1 and 1.

In this way, the intensity of the gravitational force that acts on the eluent withdrawn toward the withdrawal segment is first determined by the drop height, measured from the apical end of the chromatographic column, from the bypass segment toward the chromatographic column, and additionally, by the angle $\alpha$ whose value determines the incline of the second part connected to said valve.

The incline thus allows a gravitational flow of the sufficient predetermined volume of eluent.

Optionally, the generator according to the invention comprises means for blocking the eluent in fluid communication with said bypass segment, so as to block the passage of said volume of eluent beyond said segment end.

The presence of the blocking means makes it possible on the one hand to precisely determine the withdrawn volume, and on the other hand, optionally to avoid the overflow of said eluent volume by said free end of the second duct.

Advantageously, said free end is connected to a second sterile filter with an inverse polarity relative to that of said eluent.

Said segment end can also be directly connected to a first sterile filter with a polarity opposite that of said eluent, said first sterile filter being said blocking means of the eluent.

In this way, the air that penetrates inside the second duct and the bypass segment is sterilized, which has the advantage of providing a sterile generator whereof the eluate obtained directly is appropriate for medical use.

Preferably, the generator according to the invention comprises a pumping means arranged to be connected hermetically to an eluate outlet and designed to pump, once said valve is in its second position and after elution of the stationary phase of the chromatographic column by said sufficient volume of eluent, a fluid from the segment end or from the free end of the second duct toward the eluate outlet, said fluid being a remaining fraction of said sufficient volume of eluent present in the column or ambient air pumped from said free end or said segment end of said second duct.

As an example, the pumping means can be a vacuum container or an actuator comprising a piston mounted in a cylinder, said cylinder having a first end communicating with said eluate outlet of the chromatographic column, said piston being extended by an arm that extends outside said cylinder through an orifice present on a second cylinder end, opposite the first cylinder end, said piston having a first idle position and a fluid pumping position, said piston, when it is set in motion between said first idle position and the pumping position, generating a pumping force for the fluid.

The pumping means makes it possible, after each elution, to discharge the excess eluent present in the column and optionally to dry the latter so as to obtain a column that is dried or weakly impregnated with eluent.

By making it possible to discharge this excess eluent fragment present in the column, one thus minimizes the risk of having the parent radioisotope migrate toward the eluate outlet of the column between two successive elutions.

Other embodiments of the generator according to the invention are provided in the appended claims.

The invention further relates to an elution method for a chromatographic column of a radioisotope generator comprising an eluent reservoir and connected to the chromatographic column by a first eluent duct, said chromatographic column having a stationary phase impregnated with eluent and loaded with a parent radioisotope disintegrating spontaneously into a daughter radioisotope, said method comprising the following steps:

withdrawing a predetermined volume in a withdrawal segment of a second eluent duct connected to an upstream part of the first eluent duct and a downstream part of the first eluent duct by a valve, said withdrawal segment being defined directly between the valve and a segment end, the withdrawal being done when the valve is in a first position in which the second duct is in fluid communication with said upstream part of the first eluent duct; and an elution, under the action of a driving force of the eluent, of said predetermined volume of eluent from said withdrawal segment toward said chromatographic column when the valve is in a second position in which the second duct is in fluid communication with said downstream part of the first eluent duct, a step for drying the column by pumping sterilized ambient air from the segment end or from a free end of the second duct toward the eluent outlet, said predetermined eluent volume being a sufficient volume to obtain, when said sufficient volume crosses through the chromatographic column, an eluate comprising a parent radioisotope activity comprised in a value range from 0.0% to 30.0% relative to a daughter radioisotope activity of said eluate.

Preferably, the method comprises a step for blocking the eluent, after said injection step, so as to block the passage of said volume of eluent past said segment end.

The method may further comprise a bleeding step, carried out before the drying step, when the valve is in its second position and after elution of the stationary phase of the chromatographic column by the sufficient eluent volume, which consists of pumping a remaining fraction of the sufficient volume of eluent present in the column.

Alternatively, the parent radioisotope activity is comprised in a value range from 0.0% to 20%, advantageously from 0.0% to 10%, more preferably from 0.0% to 5.0%, still more preferably from 0.0% to 2.0%, more advantageously from 0.0% to 1.0%, relative to the daughter radioisotope activity of said eluate. Advantageously, the parent radioisotope activity is equal to 0.0 mCi.

Other embodiments of the method according to the invention are provided in the appended claims.

Other features and advantages of the invention will emerge from the description provided below, non-limitingly and in reference to the examples described below.

FIG. 1 diagrammatically shows a first embodiment of the generator according to the invention.

Figure 2A:
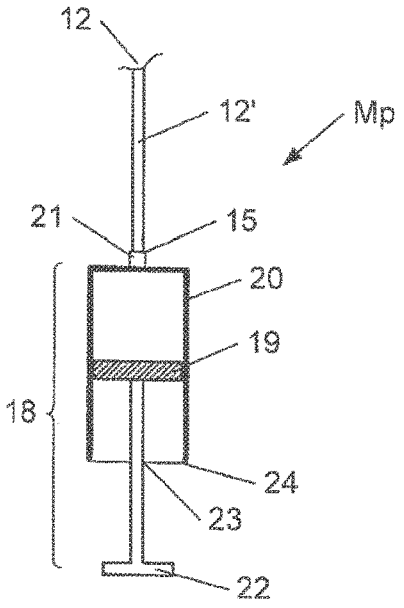
Figure 2B:
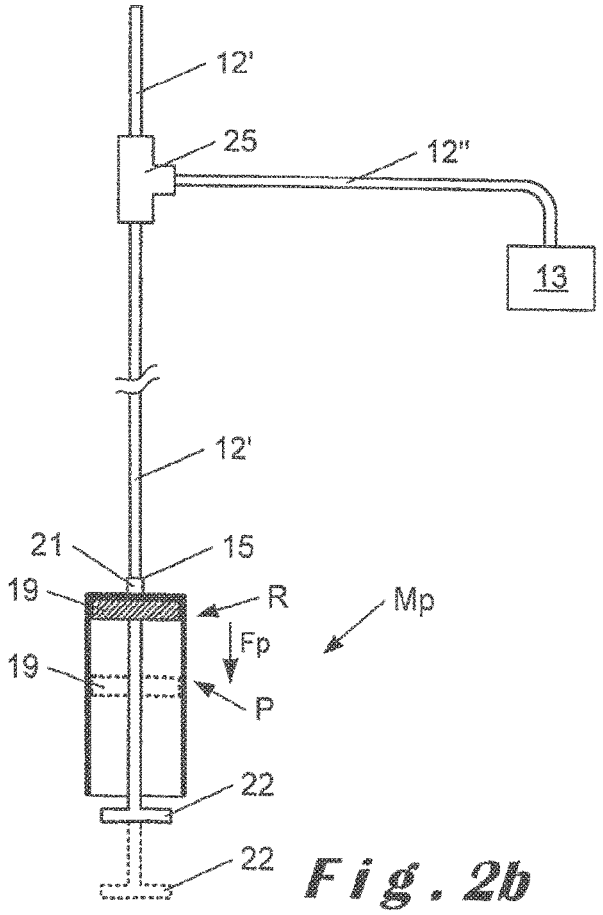

FIGS. 2*a* and 2*b* diagrammatically illustrate two possible alternatives of a second embodiment of the generator according to the invention.

Figure 3:
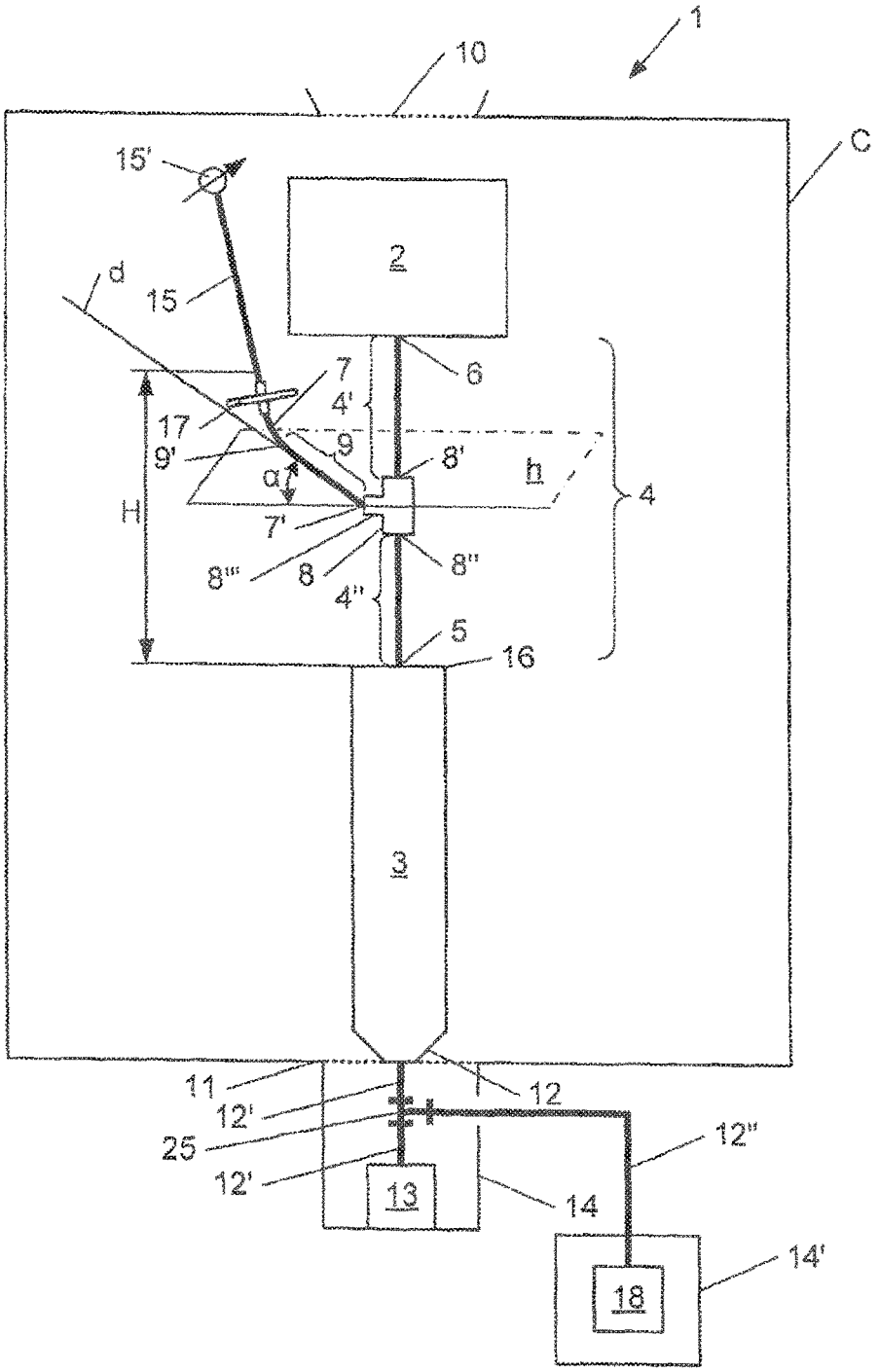

FIG. 3 diagrammatically shows a third embodiment of the generator according to the invention.

In these figures, similar elements bear the same references.

The radioisotope generator 1 according to the invention shown in FIG. 1 comprises an eluent reservoir 2 and a chromatographic column 3 connected to one another by a first eluent transmission duct 4, such that the eluent contained in the reservoir 2 is in fluid communication with the chromatographic column 3.

The chromatographic column 3 comprises a stationary phase impregnated with eluent and loaded with a parent radioisotope disintegrating spontaneously into a daughter radioisotope.

The first eluent transmission duct 4 connects an eluent inlet 5 positioned upstream from the stationary phase 2 to an eluent outlet 6 of the reservoir 2.

The radioisotope generator 1 further comprises a second duct 7 and a valve 8 connecting an upstream part 4' of the first eluent duct and a downstream part 4" of the first eluent duct. The upstream part 4' connects the eluent outlet 6 of the reservoir 2 to a first inlet 8' of the valve 8, while the downstream part 4" connects a second inlet 8" of the valve 8 to the eluent inlet 5 of the chromatographic column 3.

The valve 8 further connects an end 7' of the part connected to the second duct 7 to the upstream part 4' and downstream part 4" of the first eluent duct 4. The second duct 7 is placed in fluid communication with the valve 8 by means of a connection between the end 7' of the connected part of the second duct 7 and a third inlet 8'" of the valve 8.

In this context, the valve 8 has a first position in which the second duct 7 is in fluid communication with the upstream part 4' of the first eluent duct 4 and a second position in which the second duct 7 is in fluid communication with the downstream part 4" of the first eluent duct 4.

The second duct 7 further has a bypass segment 9 for a predetermined volume v of eluent. The segment 9 is defined directly between the valve 8 and a segment end 9'.

Typically, the predetermined volume v of eluent is defined by a bypass segment length and a bypass segment diameter.

In the first embodiment as described in FIG. 1, the segment 9 is defined between the end 7' of the connected part of the second duct 7 and the segment end 9'.

In particular, the segment end is connected to a blocking means 17 of the eluent in fluid communication with the bypass segment 9, so as to block the passage of the eluent volume beyond the segment end 9'.

The blocking means 17 can for example be a sterile filter with a polarity opposite that of the eluent whose function is to allow ambient air to pass in the bypass segment 9 and to block the passage of the eluent in a defined direction from the end 7' of the connected part of the second duct 7 toward the segment end 9'.

Preferably, the generator 1 is placed in a shielded box C for example at least partially made from a dense material, for example tungsten or lead. The box C comprises a first access opening 10 to the reservoir 2 and an outlet opening 11 positioned downstream from an eluate outlet 12 of the chromatographic column 3 and arranged to be crossed through by a second eluate outlet duct 12' arranged to connect the eluate outlet 12 of the column 3 to an eluate container 13 arranged to be positioned in a chamber 14 arranged in the box and positioned downstream from the outlet opening 11. Preferably, the eluate container 13 and/or the chamber 14 comprise(s) shielding made from a dense material, for example tungsten or lead.

In the first embodiment as illustrated in FIG. 1, the reservoir 1 is positioned above the chromatographic column 3.

The end 9' of the bypass segment 9, which can for example be a free and 15 of the second duct 7, is positioned at a predetermined height H, measured from an apical end 16 of the chromatographic column 3.

Optionally, at least one bypass segment part 9 connected to the valve 8 is inclined relative to a horizontal plane h by an angle $\alpha$ defined between the horizontal plane h and a line d secant to the horizontal plane h.

Advantageously, the angle $\alpha$ has a predetermined value such that its sine value is greater than 0 and less than or equal to 1 and its cosine value is comprised between −1 and 1.

During the operation of the first embodiment of the generator (FIG. 1), the valve 8 is first positioned in its first position. The eluent flows from the reservoir 2 through the upstream part 4' of the first duct 4 toward the second duct 7.

The bypass segment 9 fills, under the effect of the gravitational force that acts on a volume V of eluent contained in the reservoir 2, by the predetermined volume v of eluent according to a bypass flow rate at a value predetermined by the length of the bypass segment diameter 9.

The air contained in the segment is driven toward the sterile filter 17 by the eluent. The travel of the eluent from the reservoir toward the free end 15 is stopped by the presence of the sterile filter 17.

The height H and the value of the angle α make it possible to determine a sufficient intensity value of the gravitational force that acts on the sufficient volume $v_s$ of eluent withdrawn so as to allow the flow of the sufficient volume of eluent through the segment 9.

Once the predetermined volume v of eluent is withdrawn from the reservoir, the valve is next positioned in its second position.

The eluent flows from the withdrawal segment 9 through the chromatographic column 3 according to an elution flow rate determined by the pressure drop of the chromatographic column 3.

The predetermined volume v of eluent is a sufficient volume $V_s$ to obtain, when the sufficient volume crosses under the action of a driving force of the eluent, which may for example be a drawing-off force of the eluent generated by a pump system connected to the outlet of the chromatographic column 3 at the determined elution flow rate, an eluate comprising a parent radioisotope activity comprised in a value range from 0.0% to 30.0% relative to a daughter radioisotope activity of said eluate. The parent radioisotope activity in the eluate is preferably comprised in a value range from 0.0% to 20.0%, more preferably from 0.0% to 10.0% relative to the daughter radioisotope activity of said eluate.

More preferably, the parent radioisotope activity is comprised in a value range from 0.0% to 5.0% relative to the daughter radioisotope activity of said eluate.

Still more preferably, the parent radioisotope activity is comprised in a value range from 0.0% to 2.0% relative to the daughter radioisotope activity of said eluate.

More advantageously, the parent radioisotope activity is comprised in a value range from 0.0% to 1.0% relative to the daughter radioisotope activity of said eluate.

Quite advantageously, the parent radioisotope activity is preferably equal to 0.0 mCi.

FIGS. 2*a* and 2*b* illustrate part of two separate alternatives of a second embodiment of the generator 1 according to the invention.

The second embodiment copies the features of the first embodiment and, additionally, a pumping means $M_P$ arranged to be connected hermetically to the eluate outlet 12. The pumping means $M_P$ can for example be a vacuum container.

Alternatively, the pumping means $M_P$ can be an actuator 18 comprising a piston 19 mounted in a cylinder 20 (FIG. 2*a*).

The cylinder 20 has a first end 21 communicating with the eluate outlet 12 of the chromatographic column 3.

The piston 19 is extended by an arm 22 that extends outside the cylinder 20 through an orifice 23 present on a second cylinder end 24, opposite the first cylinder end 21.

The piston has a first idle position R and a pumping position P (see FIG. 2*b* by equivalence).

During operation, after a first elution and before a second subsequent elution, the first valve 8 is kept in its second elution position and the pumping means $M_P$ is hermetically connected to the eluate outlet 12 while ensuring that the valve 8 is positioned in its second position.

Preferably, the eluate outlet is extended by a needle that is connected to a vacuum capsule by piercing a tight wall covering a fluid inlet orifice present on the capsule.

Once the needle penetrates the capsule, a residual volume of said eluent volume that is free, i.e., that is not retained in the stationary phase of the column, and that stagnates in the column, is automatically suctioned in the capsule.

By making it possible to evacuate this residual excess eluent volume present in the column, one thus minimizes the risk of having the parent radioisotope migrate toward the eluate outlet of the column between two successive elutions.

Once this free eluent is suctioned, ambient air is next expelled from the free end 15 or the segment 9 end 9' of the second duct 7 so as to dry the excess eluent fraction.

The suctioning of the free eluent and the passage of air in the column therefore make it possible to bleed and dry the latter so as to obtain, between two elutions, a column that is dried or weakly impregnated with eluent.

Once the bleeding and drying of the column are done, the capsule is disconnected from the eluate outlet 12 and the eluate container 13 is once again connected to the column. Similarly to the vacuum capsule, the container comprises a tight wall designed to be crossed through by the needle positioned in the extension of the eluate outlet 12 of the column 3.

A new elution is next done first by positioning the first valve 8 in its first position to load the bypass segment 9 with eluent, and next by positioning the first valve 8 in its second elution position. This new elution is next followed by a new bleeding and drying step.

Thus, once a first elution is complete, the activity of the daughter radioisotope, which does not cease to be generated in the column from the parent radioisotope loaded on the column, increases to reach an activity threshold value that cannot be exceeded and that is governed by a secular equilibrium between the parent radioisotope and the daughter radioisotope. A cycle is thus formed, and it is the frequency between each successive elution (second, third, etc. elution) after the first elution that determines the respective parent and daughter radioisotope activities in the eluate obtained for each of these successive elutions.

Furthermore, the actuator 18 can be hermetically connected by a second valve 25 to the eluate outlet 12 (FIG. 2*b*).

The second valve 25 has an elution position in which the third duct 12' is in fluid communication with the eluate container 13 via a fourth duct 12" connecting the eluate container 13 to the valve, and a bleeding position in which the third duct 12' is in fluid communication with the pumping means.

During operation, after a first elution and before a second subsequent elution, the second valve 25, initially in its elution position, is positioned in its bleed position, while the first valve 8 is kept in its second elution position. The piston is next set in motion between its first idle position R and its second pumping position P, which generates a pumping force of the remaining fraction of the sufficient volume of eluent.

The remaining fraction of the sufficient volume of eluent is therefore conveyed from the chromatographic column 3 toward the cylinder 20 of the actuator 18, which fills with eluent.

If the piston is kept in motion and when the free eluent is suctioned from the column, ambient air is next pumped from the free end 15 or the segment 9 end 9' of the second duct 7 so as to drive the excess eluent fractions in order to obtain a column that is maximally impregnated with eluent.

Once the bleeding and drying of the column are done, the second valve 25 is positioned in its first position and a new elution is done by first positioning the first valve 8 in its first position to load the bypass segment 9 with eluent, and next by positioning the first valve 8 in its second elution position.

This new elution will next be followed by a new bleeding and drying step.

The generator according to a third embodiment (FIG. 3) further comprises a pressure switch 15' connected to the free end 15 of the second duct or to the segment 9 end 9'.

In this third embodiment of the generator according to the invention, the pressure switch 15' makes it possible to monitor the elution flow rate of the sufficient volume of eluent as well as a bleed flow rate, i.e., a pumping flow rate of the eluent, and a drying flow rate, i.e., a pumping flow rate of the air through the column, and to determine any operating anomalies of the generator.

For each of the embodiments of the generator described above, the choice of the sufficient predetermined volume is determined by the elution profile of the radioisotopes and therefore: (i) by the physicochemical properties of the chromatographic column and the eluent; (ii) and by the pair of parent and daughter radioisotopes used.

In reference to FIGS. 1 and 2, the present invention also pertains to an elution method for a chromatographic column 3 of a radioisotope generator 1 comprising an eluent reservoir 2 and connected to a chromatographic column 3 by a first eluent duct 4, said chromatographic column 3 having a stationary phase impregnated with eluent and loaded with a parent radioisotope disintegrating spontaneously into a daughter radioisotope.

The method according to the invention comprises the following steps:

withdrawing a predetermined volume in a withdrawal segment 9 of a second eluent duct 7 connected to an upstream part 4' of the first eluent duct 4 and a downstream part 4" of the first eluent duct 4 by a valve 8, said withdrawal segment 9 being defined directly between the valve 8 and a segment end 9'. The withdrawal is done when the valve 8 is in a first position in which the second duct 7 is in fluid communication with said upstream part 4' of the first eluent duct; and an elution step, under the action of a driving force of the eluent, of said predetermined volume of eluent from said withdrawal segment 9 toward said chromatographic column 3 when the valve 8 is in a second position in which the second duct 7 is in fluid communication with said downstream part 4" of the first eluent duct 4.

The method further comprises a step for drying the column by pumping ambient air from the segment 9 and 9' or from a free end 15 of the second duct 17 toward the eluate outlet 12.

The ambient air is sterilized by passing through the sterile filter 17 present on the second duct 7.

A bleeding step can be carried out before the drying step. This bleeding step is performed when the valve 8 is in its second position and after elution of the stationary phase of the chromatographic column 3 by the sufficient volume of eluent, which consists of pumping a remaining fraction of the sufficient volume of eluent present in column 3.

In this method, the predetermined volume of eluent is a sufficient volume to obtain, when the sufficient volume crosses through the chromatographic column 3, an eluate comprising a parent radioisotope activity comprised in a value range from 0.0% to 30.0% relative to a daughter radioisotope activity of the eluate.

Preferably, the method comprises a step for blocking the eluent, after said injection step, so as to block the passage of said eluent volume past said segment end 9'.

The blocking step is ensured by the presence of a sterile filter 17 with a polarity opposite that of the eluent whose function is to allow air to pass in the bypass segment 9 and to block the passage of the eluent in a defined direction from the end 7' of the connected part of the second duct 7 toward the segment end 9'.

The method according to the invention makes it possible preferably to obtain a parent radioisotope activity that is comprised in a value range from 0.0% to 20% relative to the daughter radioisotope activity of said eluate.

Advantageously, the parent radioisotope activity is comprised in a value range from 0.0% to 10% relative to the daughter radioisotope activity of said eluate.

More preferably, the parent radioisotope activity is comprised in a value range from 0.0% to 5.0% relative to the daughter radioisotope activity of said eluate.

Still more preferably, the parent radioisotope activity is comprised in a value range from 0.0% to 2.0% relative to the daughter radioisotope activity of said eluate.

More advantageously, the parent radioisotope activity is comprised in a value range from 0.0% to 1.0% relative to the daughter radioisotope activity of said eluate.

Advantageously, the parent radioisotope activity is equal to 0.0 mCi.

The results relative to the operation of the generator according to the present invention are described below for illustrative purposes and should in no way be considered limiting.

These results are relative to loading and elution tests of the generator according to the invention for different parent/daughter radioisotope pairs and different stationary phases.

Operational Mode

Loading of the Generator

Test 1 pertains to the $^{99}$Mo/$^{99m}$Tc pair (parent/daughter) on a first titanium-based stationary phase of a first generator according to the invention done in aqueous phase with an acid pH. The activity loaded on the stationary phase was 27.9 mCi during the loading time $T_0$.

Test 2 pertains to the $^{99}$Mo/$^{99m}$Tc pair and a second aluminum-based stationary phase of a second generator according to the invention done in aqueous phase with an acid pH. The activity loaded of the stationary phase was 57.8 mCi at the loading time $T_0$.

Elution Test

For tests 1 and 2, the reservoir consists of a pouch of NaCl saline solution concentrated at 0.9 vol %.

The two generators were diluted daily for a determined period in order to monitor the elution performance and the release rates of $_{99}$Mo in each of the eluates withdrawn daily (breakthrough).

Results

The elution performance Y (in %) is understood in the context of the present invention as the ratio of the activity of the $^{99m}$Tc [A($^{99m}$Tc)$^{el}$ in mCi] in the eluate and the activity of the $^{99m}$Tc [A($^{99m}$Tc$^{col}$ mCi] that is present on the column at the time of the elution and is calculated using the following formula:

$$Y(\text{in }\%)=100\times[A(^{99m}Tc)^{el}/A(^{99m}Tc)^{col}]$$

The $^{99}$Mo release rates are given in % and correspond of the following ratio:

$R=100\times[A(^{99}Mo)^{el}/A(^{99m}Tc)_{el}]$, where $A(^{99}Mo)^{el}$ represents the $^{99}$Mo activity in the eluate.

The results relative to tests 1 and 2 are provided in tables 1 and 2 below:

TABLE 1.0

| $^{99}Mo/^{99m}Tc$ pair on $TiO_2$ - test 1 | | |
|---|---|---|
| Time T | Y (in %) | R (%)* |
| $T_0$ | 99 | $<1.4\ 10^{-6}$ |
| $T_0$ + 1 day | 91 | $<1.6\ 10^{-6}$ |
| $T_0$ + 2 days | 93 | $<2.0\ 10^{-6}$ |
| $T_0$ + 8 days | 95 | $<1.9\ 10^{-6}$ |
| $T_0$ + 9 days | 95 | $<3.2\ 10^{-7}$ |
| $T_0$ + 10 days | 95 | $<1.4\ 10^{-6}$ |
| $T_0$ + 11 days | 97 | $<1.6\ 10^{-6}$ |
| $T_0$ + 13 days | 94 | $<6.4\ 10^{-6}$ |
| $T_0$ + 14 days | 96 | $<6.9\ 10^{-6}$ |
| $T_0$ + 15 days | 98 | $<6.8\ 10^{-6}$ |
| $T_0$ + 16 days | 98 | $<7.1\ 10^{-6}$ |
| $T_0$ + 17 days | 95 | $<9.0\ 10^{-6}$ |
| $T_0$ + 21 days | 94 | $<3.0\ 10^{-6}$ |
| $T_0$ + 22 days | 94 | $<2.1\ 10^{-6}$ |

*The specifications of the European pharmacopeia (Monographs for sodium pertechnetate ($^{99m}Tc$) for injection produced by fission "Eur. Phar. 0124" and Monographs for sodium pertechnetate ($^{99m}Tc$) for injection not produced by fission "Eur. Phar. 0283") provide a threshold value not to be exceeded of approximately 0.1%.

TABLE 2

| $^{99}Mo/^{99m}Tc$ pair on $Al_2O_3$ - test 2 | | |
|---|---|---|
| Time T | Y (in %) | R (in %)* |
| $T_0$ | 92 | $<4.4\ 10^{-4}$ |
| $T_0$ + 1 day | 100 | $<3.1\ 10^{-4}$ |
| $T_0$ + 2 days | 100 | $<2.3\ 10^{-4}$ |
| $T_0$ + 3 days | 100 | $<1.2\ 10^{-4}$ |
| $T_0$ + 6 days | 100 | $<3.3\ 10^{-4}$ |
| $T_0$ + 7 days | 101 | $<4.5\ 10^{-5}$ |
| $T_0$ + 9 days | 99 | $<2.8\ 10^{-4}$ |
| $T_0$ + 10 days | 101 | $<6.3\ 10^{-5}$ |
| $T_0$ + 13 days | 99 | $<5.0\ 10^{-5}$ |
| $T_0$ + 14 days | 99 | $<2.7\ 10^{-5}$ |

*The specifications of the European pharmacopeia (Monographs for sodium pertechnetate ($^{99m}Tc$) for injection produced by fission "Eur. Phar. 0124" and Monographs for sodium pertechnetate ($^{99m}Tc$) for injection not produced by fission "Eur. Phar. 0283") provide a threshold value not to be exceeded of approximately 0.1%.

Based on tests 1 and 2 and a reference test, the values illustrated in Table 3 are found:

TABLE 3

| Pair // stationary phase | Y (in %) | R (in %)* |
|---|---|---|
| $^{68}Ge/^{68}Ga$ // $TiO_2$§ | >70%§§§ | $10^{-4}$-$10^{-6}$§§§§ |
| $^{99}Mo/^{99m}Tc$ // $TiO_2$§§ | ~95% | ~$10^{-6}$-$10^{-7}$ |
| $^{99}Mo/^{99m}Tc$ // $Al_2O_3$§§ | ~100% | $10^{-4}$-$10^{-5}$ |

§Values measured at time T = $T_0$

§§Average values

§§§Y (in %) = 100 × [$A(^{68}Ga)^{el}/A(^{68}Ge)^{col}$]

§§§§R = 100 × [$A(^{68}Ge)^{el}/A(68^{Ga})^{el}$], where $A(^{68}Ge)^{el}$ represents the activity of $^{68}Ge$ in the eluate.

*The specifications of the European pharmacopeia (Monographs for sodium pertechnetate ($^{99m}Tc$) for injection produced by fission "Eur. Phar. 0124"; Monographs for sodium pertechnetate ($^{99m}Tc$) for injection not produced by fission "Eur. Phar. 0283" and Monographs for "Gallium solution ($^{68}Ga$) (Chloride) for radioactive labeling" "Eur Phar 2464") provide a threshold value not to be exceeded of approximately 0.1%.

As shown by the results provided above, the parent radioisotope activity detected in the eluate is on average lower by a factor of $10^{-6}$ -$10^{-8}$ relative to the daughter radioisotope activity in the same eluate, which means a parent radioisotope activity of less than 1.0% relative to the daughter radioisotope activity of the eluate, which is quite remarkable.

Of course, the present invention is in no way limited to the embodiments described above, and changes may be made thereto without going beyond the scope of the appended claims.

For example, the generator according to the present invention may be used in applications other than use for pharmaceutical or medical purposes.

Furthermore, although the description discloses a generator comprising a valve, it is understood that the present invention is not limited to a generator comprising only one valve, but also covers other embodiments in which several valves fluidly connect the withdrawal segment to the reservoir and the column.

As an illustration, a fourth embodiment in which the generator comprises a first valve connecting the withdrawal segment to the reservoir and a second valve connecting the same segment to the chromatographic column can of course be considered as an equivalent implementation of the generator according to the invention.

The invention claimed is:

1. A radioisotope generator, comprising an eluent reservoir and a chromatographic column connected to one another by a first eluent transmission duct, said chromatographic column having a stationary phase loaded with a parent radioisotope disintegrating spontaneously into a daughter radioisotope, said generator being characterized in that it comprises a second duct and a valve housed between an upstream part of the first eluent duct and a downstream part of the first eluent duct, and connecting said second duct to said upstream part of the first eluent duct and to the downstream part of the first eluent duct, said valve having a first position in which the second duct is in fluid communication with said upstream part of the first eluent duct and a second position in which the second duct is in fluid communication with said downstream part of the first eluent duct, said second duct having a bypass segment for a predetermined volume of eluent, said segment being defined directly between said valve and a segment end, said predetermined eluent volume being a sufficient volume to obtain, when said sufficient volume crosses through the chromatographic column, under the action of a driving force of the eluent, an eluate comprising a parent radioisotope activity comprised in a value range from 0.0% to 30.0% relative to a daughter radioisotope activity of said eluate, and wherein said generator comprises means for blocking the eluent in fluid communication with said bypass segment, so as to block the passage of said eluent volume past said segment end.

2. The generator according to claim 1, wherein said segment end is directly connected to a first sterile filter with a polarity opposite that of said eluent, said first sterile filter being said blocking means of the eluent.

3. The generator according to claim 2, comprising a pumping means arranged to be connected hermetically to an eluate outlet and designed to pump, once said valve is in its second position and after elution of the stationary phase of the chromatographic column by said sufficient volume of eluent, a fluid from the segment end or from the free end of the second duct toward the eluate outlet, said fluid being a remaining fraction of said sufficient volume of eluent present in the column or ambient air pumped from said free end or said segment end of said second duct.

4. The generator according to claim 3, wherein said pumping means is a vacuum container.

5. The generator according to claim 3, wherein the pumping means is an actuator comprising a piston mounted in a cylinder, said cylinder having a first end communicating with said eluate outlet of the chromatographic column, said piston being extended by an arm that extends outside said cylinder through an orifice present on a second cylinder end, opposite the first cylinder end, said piston having a first idle position and a fluid pumping position, said piston, when it is set in motion between said first idle position and said pumping position, generating a pumping force for the fluid.

6. The generator according to claim 1, wherein said free end is connected to a second sterile filter with an inverse polarity relative to that of said eluent.

7. The generator according to claim 1, wherein said segment end corresponds to a free end of the second duct.

8. The generator according to claim 1, wherein said reservoir is situated above said chromatographic column, said segment end being positioned at a sufficient height, measured from an apical end of the chromatographic column, such that the gravitational force has a sufficient intensity to allow a flow of the eluent through the segment.

9. The generator according to claim 8, wherein at least one bypass segment part connected to said valve is inclined relative to a horizontal plane by an angle a defined between said horizontal plane and a line secant to said horizontal plane, said angle $\alpha$ having a predetermined value such that its sine value is greater than 0 and less than or equal to 1, and its cosine value is between −1 and 1.

10. The generator according to claim 1, positioned in a shielded box, said box preferably being at least partially made from a dense material, for example tungsten or lead.

11. The generator according to claim 1, wherein the parent radioisotope activity is comprised in a value range from 0.0% to 20%, advantageously from 0.0% to 10%, more preferably from 0.0% to 5.0%, still more preferably from 0.0% to 2.0%, more advantageously from 0.0% to 1.0%, relative to the daughter radioisotope activity of said eluate.

12. The generator according to claim 11, wherein the parent radioisotope activity is equal to 0.0 mCi.

13. An elution method for a chromatographic column of a radioisotope generator comprising an eluent reservoir and connected to a chromatographic column by a first eluent duct, said chromatographic column having a stationary phase impregnated with eluent and loaded with a parent radioisotope disintegrating spontaneously into a daughter radioisotope, said method comprising the following steps: withdrawing a predetermined volume in a withdrawal segment a second eluent duct connected to an upstream part of the first eluent duct and to a downstream part of the first eluent duct by a valve, said withdrawal segment being defined directly between the valve and a segment end, the withdrawal being done when the valve is in a first position in which the second duct is in fluid communication with said upstream part of the first eluent duct; and an elution, under the action of a driving force of the eluent, of said predetermined volume of eluent from said withdrawal segment toward said chromatographic column when the valve is in a second position in which the second duct is in fluid communication with said downstream part of the first eluent duct, a step for drying the column by pumping sterilized ambient air from the segment end or from a free end of the second duct toward the eluent outlet, said predetermined eluent volume being a sufficient volume to obtain, when said sufficient volume crosses through the chromatographic column, an eluate comprising a parent radioisotope activity comprised in a value range from 0.0% to 30.0% relative to a daughter radioisotope activity of said eluate.

14. The method according to claim 13, comprising a step for blocking the eluent, after said injection step, so as to block the passage of said volume of eluent past said segment end.

15. The method according to claim 13, comprising a bleeding step, carried out before the drying step, when said valve is in its second position and after elution of the stationary phase of the chromatographic column by the sufficient eluent volume, consisting of pumping a remaining fraction of the sufficient volume of eluent present in the column toward a bleed container connected beforehand to a column outlet.

16. The method according to claim 13, wherein the parent radioisotope activity is comprised in a value range from 0.0% to 20%, advantageously from 0.0% to 10%, more preferably from 0.0% to 5.0%, still more preferably from 0.0% to 2.0%, more advantageously from 0.0% to 1.0%, relative to the daughter radioisotope activity of said eluate.

17. The method according to claim 16, where the parent radioisotope activity is equal to 0.0 mCi.

* * * * *